United States Patent [19]

Nakamoto

[11] 4,180,008

[45] Dec. 25, 1979

[54] SOLDERLESS BELL AND METHOD OF FORMING A SOLDERLESS BELL

[76] Inventor: Kisaburo Nakamoto, 5-8, 1-chome, Matsue, Atsugi-shi, Kanagawa-ken, Japan

[21] Appl. No.: 927,604

[22] Filed: Jul. 24, 1978

[51] Int. Cl.[2] ..... G10K 1/06; B21D 28/00

[52] U.S. Cl. ..... 116/170; 113/116 V

[58] Field of Search ..... 116/170; 29/161, 510, 29/513; 113/116 AA, 116 V

[56] References Cited

U.S. PATENT DOCUMENTS

| | | | |
|---|---|---|---|
| 122,679 | 1/1872 | Tencate | 116/170 |
| 364,311 | 6/1887 | Simons | 116/170 |
| 2,568,190 | 9/1951 | Frankel et al. | 116/170 |
| 2,641,079 | 6/1953 | Oster | 116/170 X |
| 2,784,526 | 3/1957 | Bouwadere | 116/170 X |
| 3,027,794 | 4/1962 | Chute | 116/170 X |
| 3,739,623 | 6/1973 | Kramer | 113/116 V X |
| 3,747,462 | 7/1973 | Mizuno | 116/170 |

FOREIGN PATENT DOCUMENTS

| | | | |
|---|---|---|---|
| 26-13434 | 11/1951 | Japan . | |
| 4511 | of 1897 | United Kingdom | 116/170 |

*Primary Examiner*—Donald Watkins

*Attorney, Agent, or Firm*—Sandler & Greenblum

[57] ABSTRACT

A method of forming a solderless bell, having a single sound opening, out of a blank within a strip, is disclosed, which comprises the steps of: forming a crown within the blank; separating the blank from the strip, said blank comprising a central portion and peripheral flap portions; inserting a clapper within the central portion; and closing the peripheral flap portions around the central portion, to form said sound opening, thereby encasing the clapper within the central portion and the peripheral flap portions to form the bell.

A solderless bell is disclosed which comprises: a container, a clapper located within said container; a single sound opening consisting of a single longitudinal slit located at the bottom of the container; and a crown arranged on the top of said container, said crown being integral with the container and protruding therefrom.

27 Claims, 11 Drawing Figures

SOLDERLESS BELL AND METHOD OF FORMING A SOLDERLESS BELL

BACKGROUND OF THE INVENTION

1. Field of the Invention

The invention relates to strong seamless bells requiring no solder which may be used to provide high quality tone and to a method for making such bells which makes it possible to produce the bells at low cost.

2. Description of the Prior Art

Bell instruments date back many years and exist in wide varieties of shape and design.

The basic structure of a bell has generally included a container, normally made of metal with a clapper element arranged therein. The bell comprises openings through which sound generated by the clapper leaves the container.

In order that the bell may be supported in a manner so as to provide minimal interference with the sound generating capabilities of the bell, a crown or ring is provided through which a string or the like may be inserted.

As may be seen from FIG. 1, one type of conventional device comprises two cup shaped hemispheres 1 and 2. A sound opening 3 is located at the bottom of hemisphere 2. Sound generated by a metal ball 4 which acts as a clapper leaves the container through the sound opening. The hemispheres are soldered together along their peripheral edges 1*a* and 2*a*. A support ring 5, through which a slip string or the like may be inserted, is soldered to hemisphere 1.

Alternatively, bells of the type shown in FIG. 2 have been produced in which two hemispheres 11 and 12 are seamed to one another by means of a protruded flange 11*a* being clamped around a flange 12*a*. In this embodiment a support ring or crown is provided by slitting hemisphere 11 and elevating the slit portion relative to a depressed portion to form an opening 16.

As will be readily noted, the embodiments of FIGS. 1 and 2 require supplemental machining operations which add to the cost of the bells as well as detract from their appearance and tonal qualities. In the embodiment of FIG. 1 two soldering operations are necessary; one to secure the hemispheres to one another, the other to attach the ring 5 to the top of hemisphere 1. In addition to increasing cost, the soldering also affects the quality of the sound emitted by the bell due to the softness of the soldered portions and the clinging of the impure solder metal material. In the embodiment of FIG. 2, the opening 6 diverts part of the sound leaving the bell from opening 13. Furthermore, the seam formed by flanges 11*a* and 12*a* are unsightly and also affect tonal quality.

FIGS. 3 and 4 illustrate another bell known in the art. In this embodiment, the bell 21 has walls which are seamless and are made of a single piece of metal. Such a bell is produced by dividing a portion of sheet metal into sections 22, 23, 24 and 25 in a manner such that each of these portions may be bent over and curved to form the bell with the clapper inside. However, in this embodiment, as was the case with the embodiment of FIG. 2, slits must be made in the upper portion of the bell so that a lengthy section 26 may be elevated from the bell body to provide an opening for a slip cord. As a result of opening 27, through which some sound escapes, as well as the criss-cross sound opening, the bell has poor echo qualities, thus resulting in lower sound quality. This bell, in addition to being unsightly, therefore, is unable to provide a clean and clear sound and the sound will be dull. Additionally, since sections 22–25 have been deformed the sound generated is further degraded.

FIG. 5 illustrates yet another type of bell which although it comprises only one straight slit as a sound opening is unsatisfactory in that portions 31 and 32 are soldered together after the clapper has been placed within the bell container. Once again, as a result of the soldering step, mass production becomes too costly and sound produced is of low quality due to the softness of the soldered metal sections as well as the clinging of the solder metal.

SUMMARY OF THE INVENTION

It is, therefore, an object of the invention to provide a method of making bells which is both simple and inexpensive.

It is a further object of the invention to provide a method which avoids the use of solder while nevertheless producing a bell of attractive appearance.

It is yet another object of the invention to provide a bell having an attractive appearance yet emitting sounds of high tonal quality.

These and other objects are fulfilled according to the bell and bell-making method of the invention.

According to the method of the invention, a seamless, solderless bell having a single sound opening is formed out of a blank in a strip by the steps of: forming a crown within the blank; separating said blank from said strip, said blank comprising a central portion and peripheral flap portions; inserting a clapper within said central portion; and closing said central portion, to form a sound opening, thereby encasing the clapper within the central portion and the peripheral flap portions to form the bell.

The crown which is subsequently perforated to accomodate a slip string or the like may be formed in the blank while it is flat or after it has been pressed to provide a recess which will eventually form part of the bell wall.

In the first instance, the crown is formed in the blank while it is still flat and the blank is then pressed to form a recess in the blank which is bordered by peripheral flap portions or flanges. After having been pressed, the blank is separated from the strip as by stamping or cutting, a clapper is inserted and the flap portions closed around the clapper to form a bell having a single slit opening.

Alternatively, the blank may first be pressed to form a recessed portion and then pressed again to form a depressed portion within the recessed portion. The depressed portion is then shaped to form a crown after which the blank is stamped from the strip, filled with a clapper, and closed to form a bell.

The bell of the invention is a seamless, solderless bell comprising a container, a clapper located within the container; a single sound opening located at the bottom of said container, said opening consisting of a single longitudinal slit; and a crown arranged on top of said container which is integral with the container and protrudes therefrom.

DESCRIPTION OF THE PREFERRED EMBODIMENTS

Figure 1:
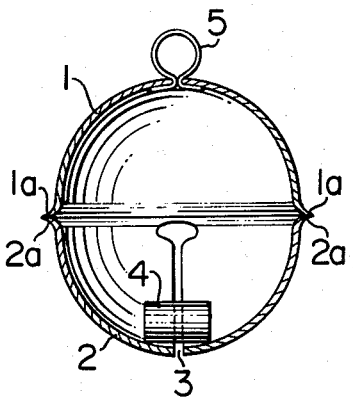
FIG. 1 PRIOR ART
FIG. 1 illustrates a cross-sectional view of a first type of conventional bell.
Figure 2:
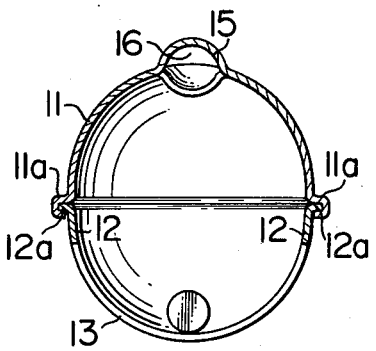
FIG. 2 PRIOR ART
FIG. 2 illustrates a cross-sectional view of a second type of conventional bell.
Figure 3:
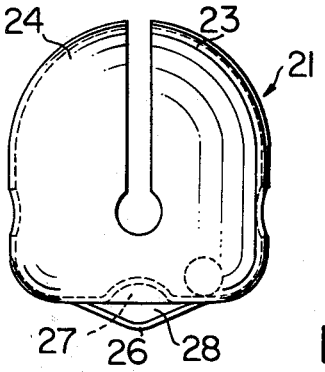
FIG. 3 PRIOR ART
FIG. 3 illustrates a front view of a third type of conventional bell.
Figure 4:
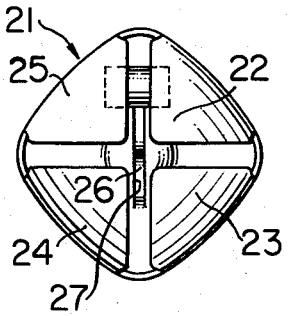
FIG. 4 PRIOR ART
FIG. 4 illustrates a planar view of the bottom of the bell of FIG. 3.
Figure 5:
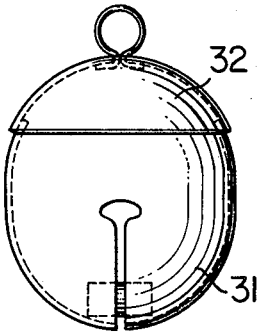
FIG. 5 PRIOR ART
FIG. 5 illustrates a front view of a fourth type of conventional bell.
Figure 6:
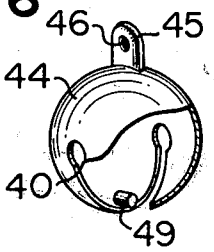
FIG. 6 illustrates a perspective view, partially cut away, of a first embodiment of a bell according to the invention.

FIG. 6 illustrates one type of bell according to the invention. The metal strip, 41, may, for example, be formed of brass or some other metal material which may be easily worked and extended. As may be seen, the bell comprises a circular container 44 comprising a single sound opening in the form of a straight slit or groove 40. The clapper 49 is located within the container and a crown 45 having an orifice 46 is arranged on top of the bell container.

Figure 7:
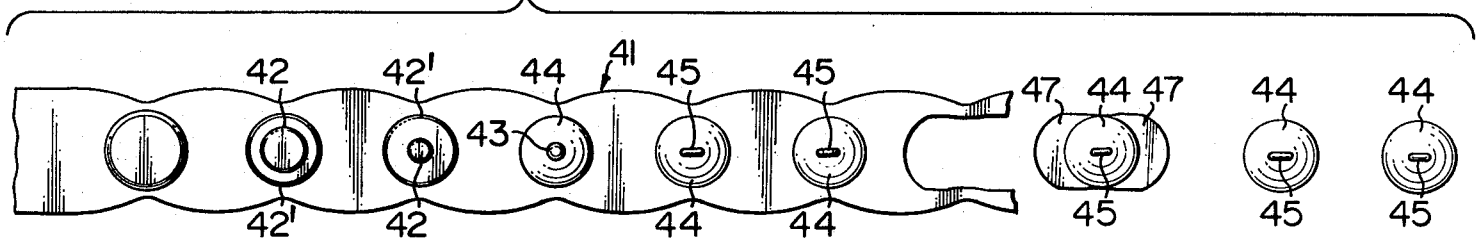
FIG. 7 is a bottom view showing a process of producing the bell of FIG. 6 from a strip.
Figure 8:
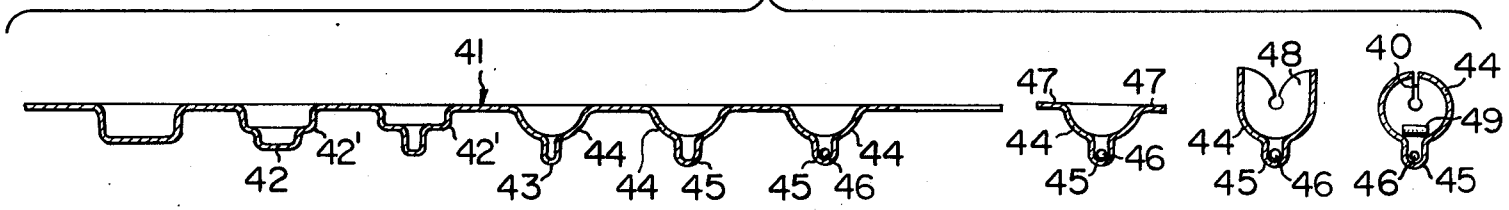
FIG. 8 is a side cross-sectional view of the strip, in the course of processing, illustrated in FIG. 7.

The production method of the invention is illustrated from left to right in FIGS. 7 and 8.

Initially, the strip 41 is drawn, pressed or pulled by appropriate means to form a recessed portion having the general cross-section shown at the far left of FIG. 8. The recessed or drawn out portion is then further pressed or drawn so as to form a depressed portion 42 within the recess 42. Next, the depressed portion 42 is further drawn or pressed to form a crown 43. As illustrated, the recessed portion 42 is further drawn to form a section 44 having a hemispherical shape. Eventually, the crown 43 is pinched from both sides to flatten it and then provided with an opening 46 for accomodating a slip cord. The inner wall surrounding the opening 46 may then be bent inwardly or filed to provide a smooth inner surface.

Once the blank used to form the bell has been fashioned from the strip as set forth above, the blank is cut or stamped to separate it from the strip. At this point the blank comprises a central portion, recessed and crowned, bordered by peripheral flaps 47. The flaps are then bent upwardly so that the blank has a U-shaped cross-section as illustrated in FIG. 8. A clapper is next inserted within the blank and the peripheral flap portions are closed around the central portion to form a sound opening which encases the clapper within the central portion and peripheral flap portions to form the bell.

In order to produce a sound opening comprising a straight lined groove or slit which produces the desirable tinkle sound of the bell, the peripheral flap portions of the blank should have semi-circular peripheral edges. When the metal is worked to close the peripheral portions, the resulting bell has a sound opening groove or slit 40 such as is illustrated in FIGS. 7 and 8. To facilitate working and to provide a bell having good tonal quality the strip is perferably annealed prior to processing. Also, the blank is perferably annealed after it has been separated from the strip.

The bell thus produced has a spherical shape with a wall made of a single piece of metal of uniform thickness as is illustrated in FIG. 6.

Since the portions of the sound opening 10, i.e., the flanges, are annealed or hardened so as to have a springing property and thus to function as a good vibrator, and since the vibrating air within the bell is discharged only through the straight-line sound opening and no other sound opening is provided as has been the case with conventional bells, the sound quality is not diminished and a clear and highly melodious sound is produced which takes full advantage of the echo effect within the bell.

Figure 9:
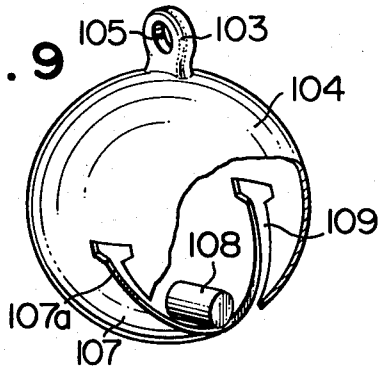
FIG. 9 is a perspective view, partially cut away, of a second embodiment of the bell of the invention.
Figure 10:
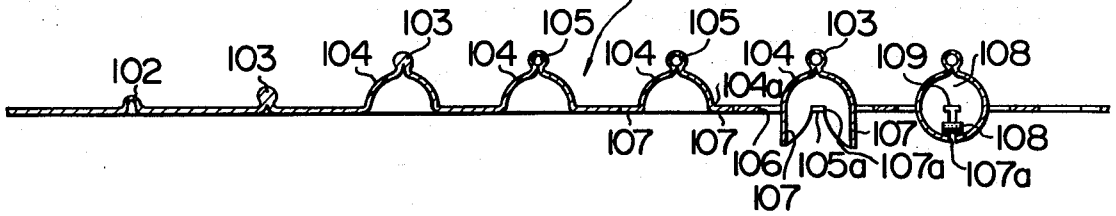
FIG. 10 is a side cross-sectional view of a strip being processed according to the invention to produce the bell of FIG. 9.
Figure 11:
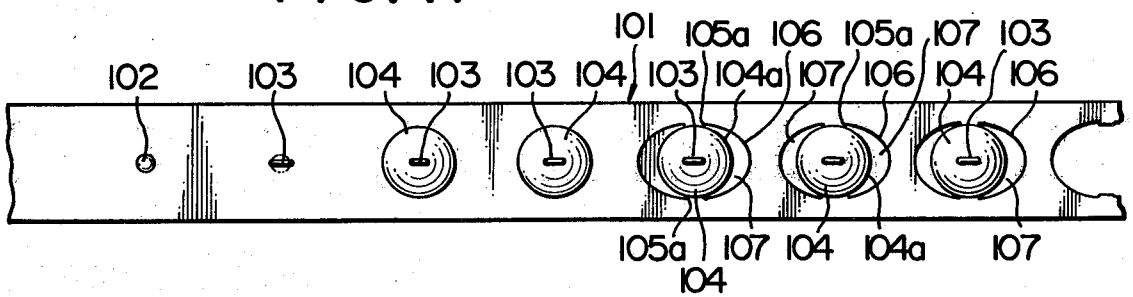
FIG. 11 is a bottom view of the process illustrated in FIG. 10.

A second embodiment of the present invention will now be explained with reference to FIGS. 9 through 11.

Initially, a semi-circular crown 102 is pulled out of a metal plate 101. The crown 102 is then pinched or pressed from both side portions so as to form a flattened crown 103. Then a semi-circular blank 104 with said crown 103 at its center portion, is drawn out and formed. The crown 103 is formed to have a sling cord opening 105.

An elliptic line 106 along which the blank 104 is to be cut out from the plate 101, and lines defining peripheral flap portions 107, are provided on the strip 101. The blank 104 is separated along the elliptic line 106 from the strip, and the blank is formed to have reverse U-shape, in cross-section, with the flaps 107, 107 being pulled downwardly. Then a clapper 108 is placed in the cavity formed in the blank 104. Finally, the two peripheral flaps 107 are formed and bent face to face so as to form sound opening 109.

As has been described, the bell of the present invention is produced by the steps of producing a straightline sound opening at the bottom portion of the bell body, putting a clapper into a bell body, and producing a projection at the head portion of the body with a sling cord opening provided therethrough. Accordingly, the bell body having a projection for providing a sling cord opening, and having no seamed portions, can be formed in a continuous manner from a metal, without requiring the troublesome soldering step which results in saving production cost.

Since the bell has no soldered portion, i.e. since it includes no impure metals, its sound is not degraded and thus produces a clean, and clear tinkling sound. In addition, since it has no seamed or soldered portion, the bell is more attractive than conventional bells where seams and soldered portions mar the surface of the bell.

Since an opening for receiving a sling which supports the bell is provided through the projection in such a manner that the circumferential margin of the projection for forming the opening, is rolled or bent inwardly, the margin around the opening is smooth and has no angular corners or edges. Accordingly, the sling cord passing through the opening, is not cut off by the angular corners or edges on the one hand, and the bell nevertheless generates a melodious bell sound swinging by the sling cord which is smoothly and rotably fitted through the opening.

According to the invention, no sound opening is provided except for a straight-line sound opening. Therefore, the air in the bell is discharged through the sound opening only, and thus, in cooperation with the fact that the portions around the opening surface are springy and vibrating, formed and hardened, clean sounds are generated without being diminished in any way. As a result, a solid and durable bell having a good appearance and producing clear and melodious sound, is provided at low cost.

The invention has been described with respect to particular forming sequences, materials, and shapes. It is to be understood, however, that the invention is not limited to any particular sequence of the steps set forth except those which are necessary to form a seamless bell consisting of a single sound opening. Similarly, although brass is referred to as the metal used, other metals which may be properly worked and annealed to form the bell of the invention may likewise be used.

I claim:

1. A method of forming a seamless, solderless bell, having a single sound opening, out of a blank in a strip, which comprises the steps of:

(a) forming a crown within said blank;

(b) separating said blank from said strip, said blank comprising a central portion and peripheral flap portions;

(c) inserting a clapper within said central portion; and (d) closing said peripheral flap portions around said central portion, to form the sound opening, thereby encasing said clapper within said central portion and said peripheral flap portions to form said bell.

2. The method of defined by claim 1, further comprising the steps of:

(i) pressing said blank to form a recessed portion in said central portion, and (ii) pressing said recessed portion to form said crown.

3. The method as defined by claim 2, further comprising pressing said recessed portion prior to forming said crown to form a depressed portion within said recess and then forming said crown out of said depressed portion.

4. The method as defined by claim 3, wherein said crown comprises an opening and is formed by flattening said depressed portion and then perforating it to form said opening.

5. The method as defined by claim 4 wherein said two flap portions are arranged on opposite sides of said recessed portion and each of said flap portions comprises a semicircular peripheral edge.

6. The method as defined by claim 5 wherein said peripheral flap portions are closed to form a sound opening comprising a single slot.

7. The solderless bell formed by the method of claim 6.

8. The method as defined by claim 1 further comprising annealing said strip prior to forming and stamping said crown.

9. The method as defined by claim 8, further comprising annealing said blank after it has been separated from said strip.

10. The method as defined by claim 1 which comprises:

(i) forming said crown in said central portion while said central portion is flat;

(ii) forming a recessed portion in said central portion;

(iii) separating said blank such that said central portion is bordered on opposite sides by said peripheral flap portions, each of said flap portions having an elliptically shaped periphery.

11. The seamless, solderless bell formed by the method of claim 10.

12. A seamless, solderless bell comprising:

(a) a container formed by stamping a blank of metal;

(b) a clapper located within said container;

(c) a single sound opening located at the bottom of said container; said opening consisting of a single longitudinal slit; and (d) a crown stamped from said blank arranged on top of said container, said crown being integral with said container and protruding therefrom.

13. The solderless bell as defined by claim 12, wherein said bell consists of only one sound opening through which sound may escape.

14. The solderless bell as defined by claim 12 wherein said container is made of annealed brass.

15. A method of forming a seamless, solderless bell, having a single sound opening, out of a blank in a strip, which comprises the steps of:

(a) forming a recessed portion in said blank;

(b) flattening at least a portion of said recessed portion to form said crown;

(c) separating said blank from said strip, said blank comprising a central portion and peripheral flap portions;

(d) inserting a clapper within said central portion;

(e) closing said peripheral flap portions around said central portion, to form the sound opening, thereby encasing said clapper within said central portion and said peripheral flap portions to form said bell;

and whereby said portion is flattened such that sound only exits through said sound opening.

16. The method as defined by claim 15, further comprising pressing said recessed portion prior to forming said crown to form a depressed portion within said recess and then forming said crown out of said depressed portion.

17. The method as defined by claim 16 wherein said crown comprises an opening and is formed by flattening said depressed portion and then perforating said depressed portion to form said opening.

18. The method as defined by claim 17 wherein said two flap portions are arranged on opposite sides of said recessed portion and each of said flap portions comprises a semicircular peripheral edge.

19. The method as defined by claim 18 wherein said peripheral flap portions are closed to form a sound opening comprising a single slot.

20. The solderless bell formed by the method of claim 19.

21. The method as defined by claim 15 further comprising annealing said strip prior to forming and stamping said crown.

22. The method as defined by claim 21, further comprising annealing said blank after it has been separated from said strip.

23. The method as defined by claim 15 which comprises:

(i) forming said crown in said central portion while said central portion is flat;

(ii) forming said recessed portion in said central portion; and (iii) separating said blank such that said central portion is bordered on opposite sides by said peripheral flap portions, each of said flap portions having an elliptically shaped periphery.

24. The seamless, solderless bell formed by the method of claim 23.

25. A seamless, solderless bell comprising:
(a) a container formed by stamping a blank of metal;
(b) a clapper located within said container;
(c) a single sound opening located at the bottom of said container; said opening consisting of a single longitudinal slit; and
(d) a crown stamped from said blank arranged on top of said container, said crown being integral with said container and protruding therefrom, said crown having no opening through which air may pass.

26. The solderless bell as defined by claim 25, wherein said bell consists of only one sound opening through which sound may escape.

27. The solderless bell as defined by claim 25 wherein said container is made of annealed brass.

* * * * *

UNITED STATES PATENT AND TRADEMARK OFFICE

CERTIFICATE OF CORRECTION

PATENT NO. : 4,180,008

DATED : December 25, 1979

INVENTOR(S) : Kisaburo Nakamoto

It is certified that error appears in the above—identified patent and that said Letters Patent is hereby corrected as shown below:

Column 5, line 31, "of" should read -- as --.

Signed and Sealed this

*Tenth* Day of *June 1980*

[SEAL]

*Attest:*

SIDNEY A. DIAMOND

*Attesting Officer*

*Commissioner of Patents and Trademarks*